US005772475A

United States Patent [19]

Lindeberg et al.

[11] Patent Number: 5,772,475

[45] Date of Patent: Jun. 30, 1998

[54] PLUG-IN CABLE CONNECTOR

[75] Inventors: Eric Lindeberg, Hovilles Franreich; Uwe Mischlich, Nauheim; Reinhard Lotz, Erzhausen, all of Germany

[73] Assignee: Thomas & Betts Corporation, Memphis, Tenn.

[21] Appl. No.: 502,623

[22] Filed: Jul. 14, 1995

(Under 37 CFR 1.47)

[30] Foreign Application Priority Data

Jul. 19, 1994 [DE] Germany ..... 44 25 466.0

[51] Int. Cl.[6] ..... H01R 13/502

[52] U.S. Cl. ..... 439/701

[58] Field of Search ..... 439/701, 680, 439/681, 686, 607, 610, 395, 397, 398

[56] References Cited

U.S. PATENT DOCUMENTS

| | | | |
|---|---|---|---|
| 3,042,895 | 7/1962 | Bonhomme | 439/701 |
| 4,923,310 | 5/1990 | Sekiguchi et al. | 439/701 |
| 5,312,276 | 5/1994 | Hnatuck et al. | 439/701 |
| 5,344,347 | 9/1994 | Inoue et al. | 439/701 |
| 5,368,505 | 11/1994 | Hoolhorst et al. | 439/701 |
| 5,393,242 | 2/1995 | VanDerStuyf | 439/701 |
| 5,584,728 | 12/1996 | Cheng | 439/701 |

FOREIGN PATENT DOCUMENTS

| | | | |
|---|---|---|---|
| 9222943 | 12/1992 | WIPO | 439/701 |

*Primary Examiner*—Hien Vu
*Attorney, Agent, or Firm*—Hoffmann & Baron, LLP

[57] ABSTRACT

A plug-in cable connector comprises an optional number of plate-shaped contact carrier modules that are provided with defining walls which partially close the duct-shaped chambers of the modules in a mirror-image fashion. In connection with the provision of a stop shoulder on a contact carrier module on one hand and the incorporation of half walls in the module carrier casing on the other hand, each of the modules may be individually inserted in an operative manner into the casing, forming a self-contained enclosed unit.

12 Claims, 10 Drawing Sheets

PLUG-IN CABLE CONNECTOR

FIELD OF THE INVENTION

The invention is directed to a plug-in cable connector.

BACKGROUND OF THE INVENTION

A plug-in cable connector is, for example, known from DE-Gbm 93 11 781.7. The known plug-in connector does in fact permit substantial simplification in manufacture because of a sectional modular structure of the plug, yet does not permit direct adaptation to the requirements made in view of the special application with respect to supply of contacts in terms of number and position on the plug strip, and polarizing and/or coding of the plugs.

SUMMARY OF THE INVENTION

The purpose underlying the present invention is to provide a plug-in cable connector which may be produced and if necessary subsequently adapted in a simple way using a few mass-produced components and by using only the functionally necessary elements, i.e. without using additional components to be regarded as spacers, according to the requirements of present applications.

The plug-in cable connector according to the invention is constructed in modular fashion; due to the mirror-image half-and-half location of the walls, in connection with the design of a stop shoulder on the contact carrier module on the one hand and the incorporation of half walls in the module carrier casing on the other hand, each of the modules may be individually inserted in an operative manner into the casing, and forms a self-contained enclosed (electrically insulated) unit when incorporated. It is not necessary to fill out the overall casing space by inserting empty modules and spacers in order to ensure the stability of mounting of the fitted module.

BRIEF DESCRIPTION OF THE DRAWING FIGURES

Further details of the invention characterized in the Patent Claims will be explained in the following with reference to the accompanying drawings, which show:

FIG. 1: A perspective view of a plug-in cable connector according to the invention with the plug casing open, and after assembly in the blade strip;

FIG. 2: A perspective exploded view of a plug-in cable arrangement before insertion into the blade strip;

FIG. 3: A perspective view of an individual contact,:

FIG. 4: A perspective view of a contact carrier module with partially occupied contact chambers and visible guide cams;

FIG. 5: A perspective view of a prepared cable;

FIG. 6: A perspective view of a contact carrier casing;

FIG. 7: The module carrier casing shown in FIG. 6 with cavities partially occupied, with tow modules;

FIG. 8: The module carrier casing shown in FIG. 6 with the cavities fully occupied, and screening provided;

FIG. 9: A perspective view of the strain relief means for the plug, in an exploded view;

FIG. 10: A perspective view of the locking means of the plug lock;

FIG. 11: An enlarged perspective view of a wall;

FIG. 12: A perspective view of an MF block.

DETAILED DESCRIPTION OF THE PREFERRED EMBODIMENT

Figure 1:
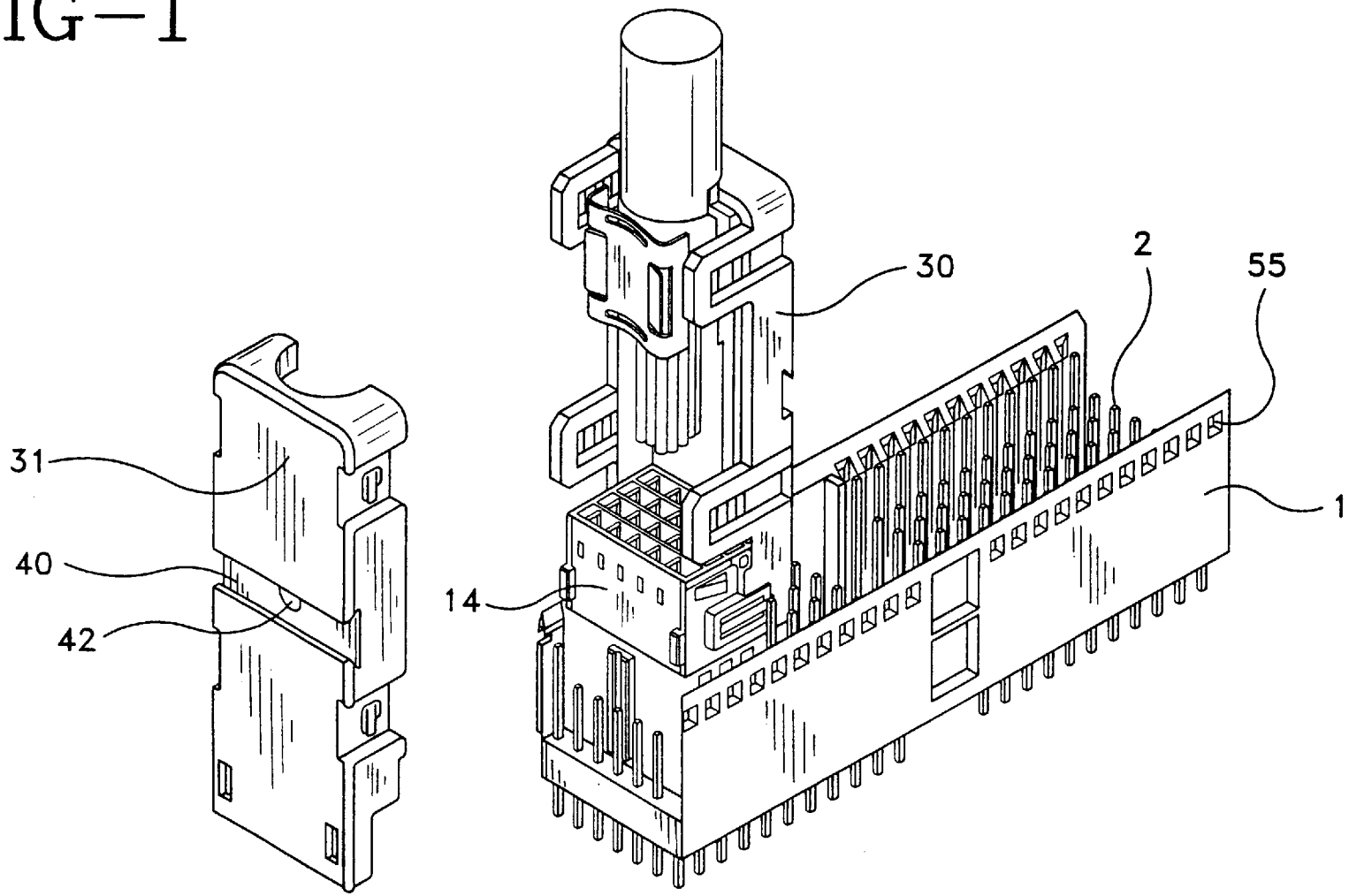

The plug-in cable connector shown in the drawing serves to produce an external electrical cable connection with the contact strip of electronic/electrical components comprising a strip casing 1 with the blade contacts 2, and also comprises a module carrier casing 14 in the case of the present example, for accommodating four plate-like contact carrier modules 3, each of which in this case has five duct-like chambers 6 lying in a row for respectively accommodating a spring contact, as counter contacts.

Figure 4:
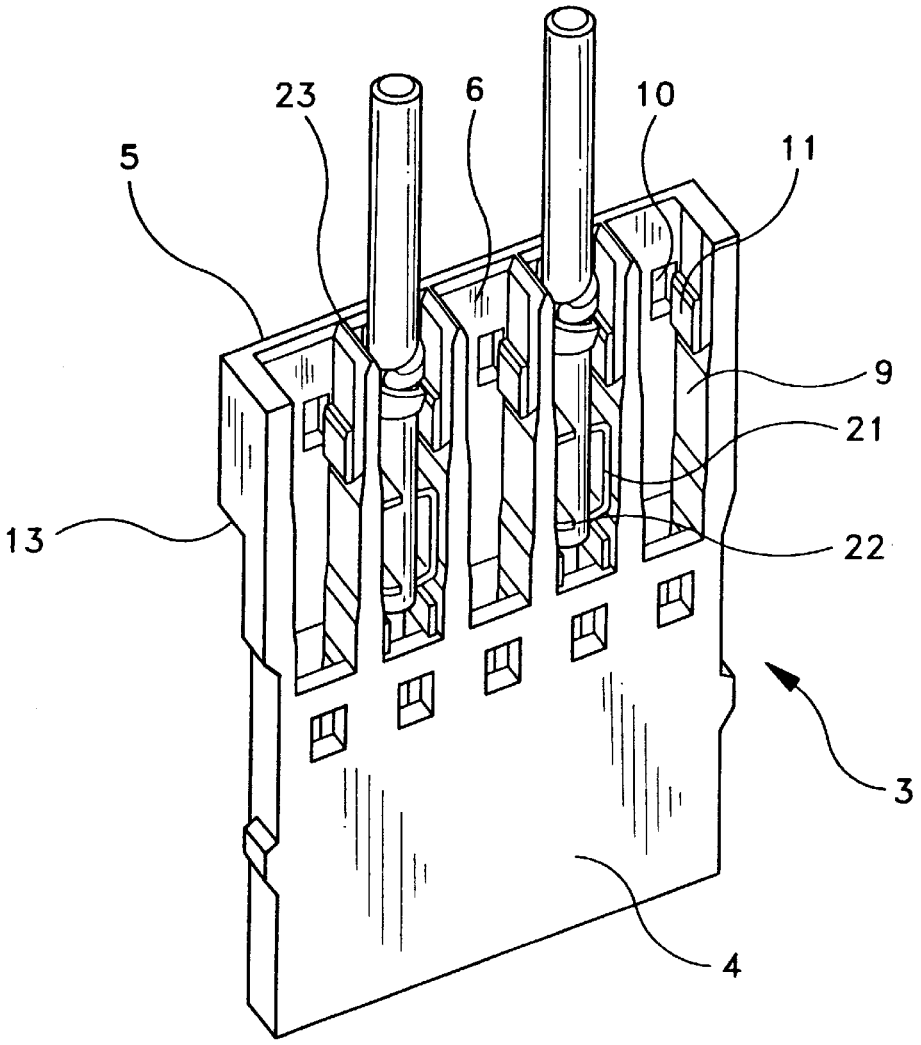
Figure 4A:
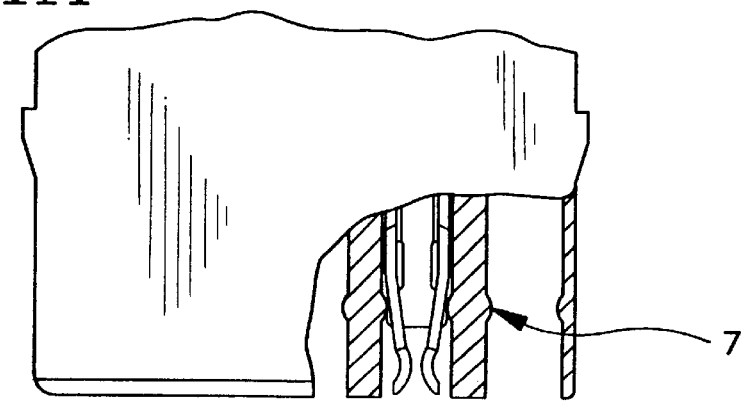
Figure 6:
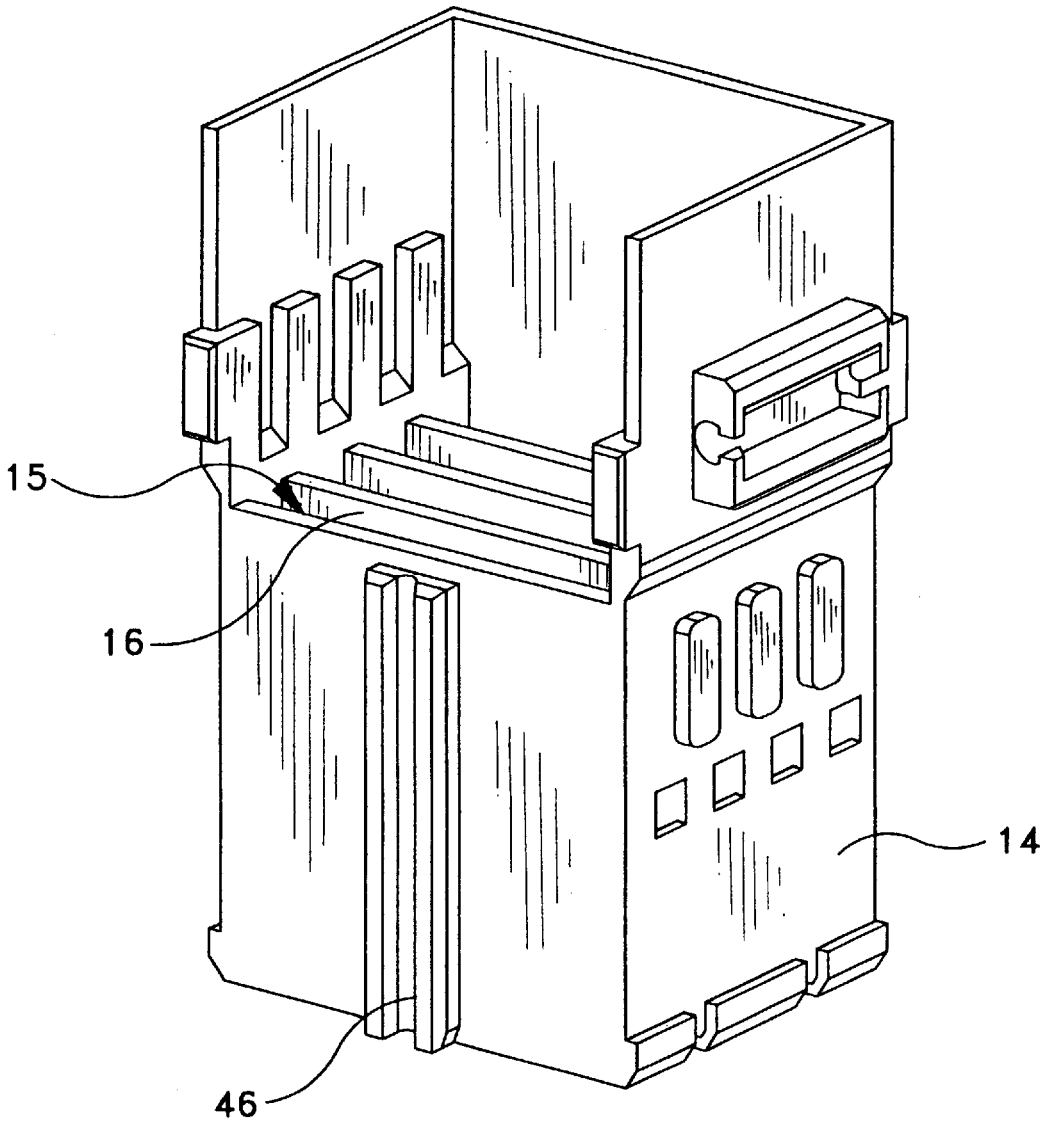
Figure 7:
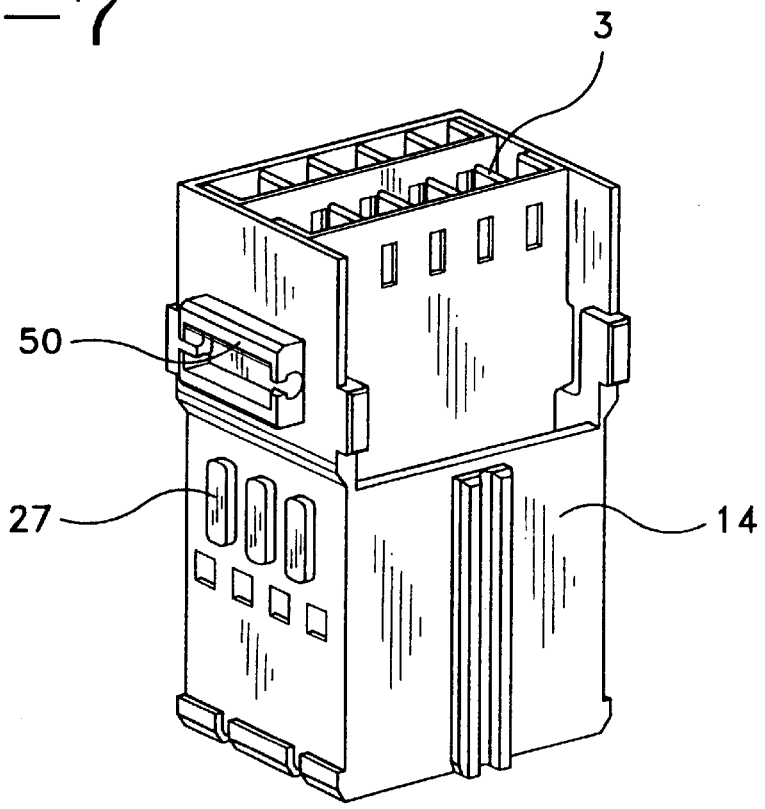
Figure 10:
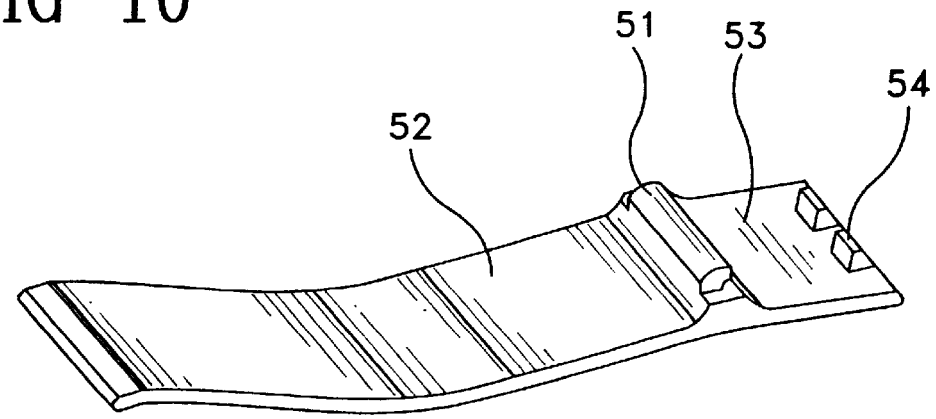
Figure 8:
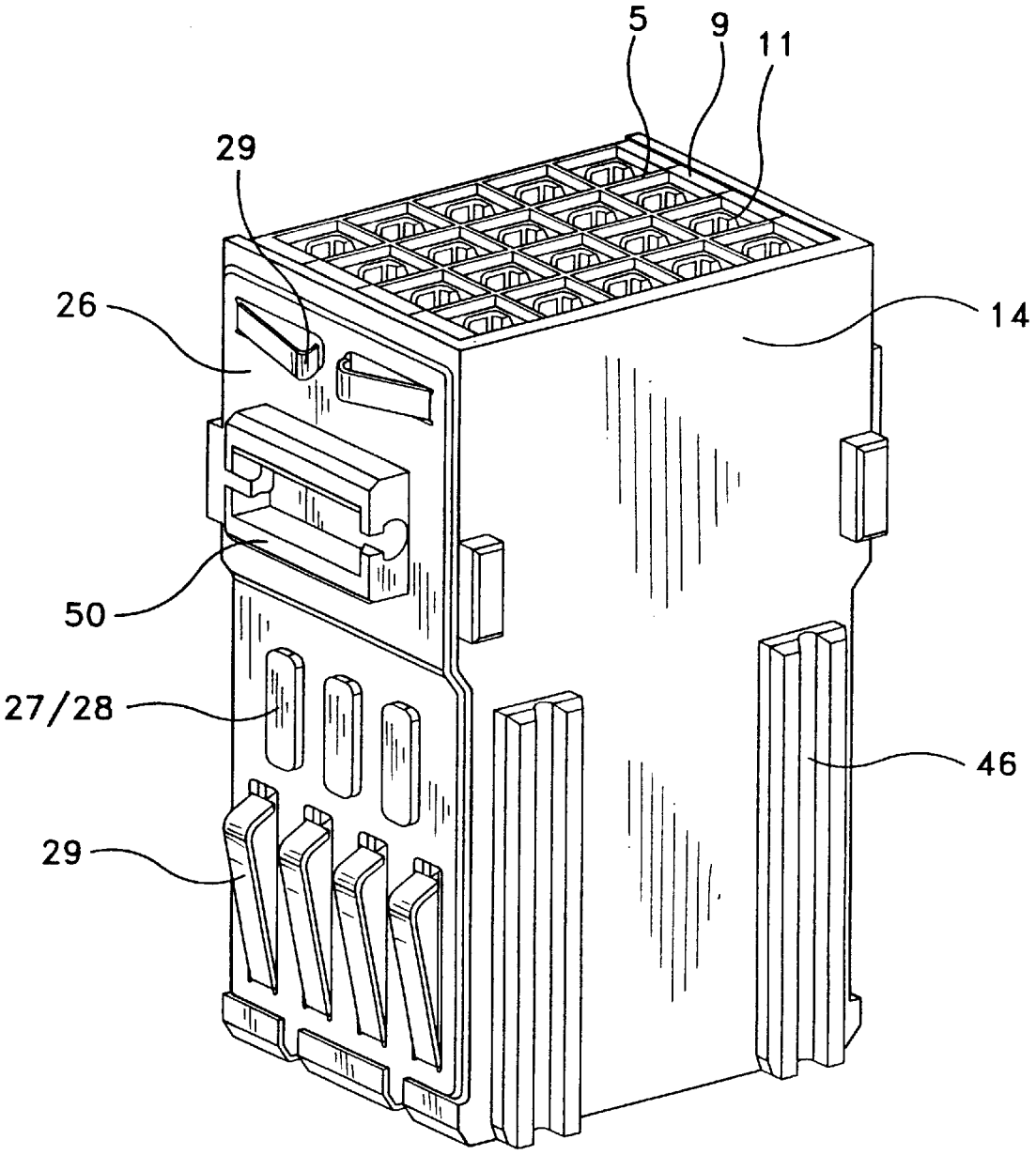

The contact carrier modules 3 are provided with defining walls 4, 5 which half enclose the chambers 6 in a mirror-image in such a way that on one side of the defining wall 4, the upperhalf of the contact carrier module 3 is closed, and on thee other side of the defining wall 5 the lower half of said contact carrier module 3 is closed, The defining wall 5 in combination with the lateral walls 9 a shoulder 13. Correspondingly the module carrier casing 14 is provided with half-height walls 16, forming cavities 15, which walls 16 form a stop means for the shoulders 13 of the contact carrier modules 3 The wall 5 and the half-height lateral walls 9 half open side portion of the complement one another to form A intermediate wall entirely covering or enclosing the contact carrier module 3. It is clearly seen from comparison of FIGS. 4, 6 and 7 that upon insertion of the contact carrier module 3 into the casing 14, due to the mirror-image half-and-half arrangement of the walls 4,5, and particularly to the design of the shoulder 13 at the defining wall 5, this wall complements the half wall 16 (FIG. 7) to form an enclosed wall extending over the entire height of the contact carrier module, and which in turn closes the open side of the next adjacent module.

Figure 9:
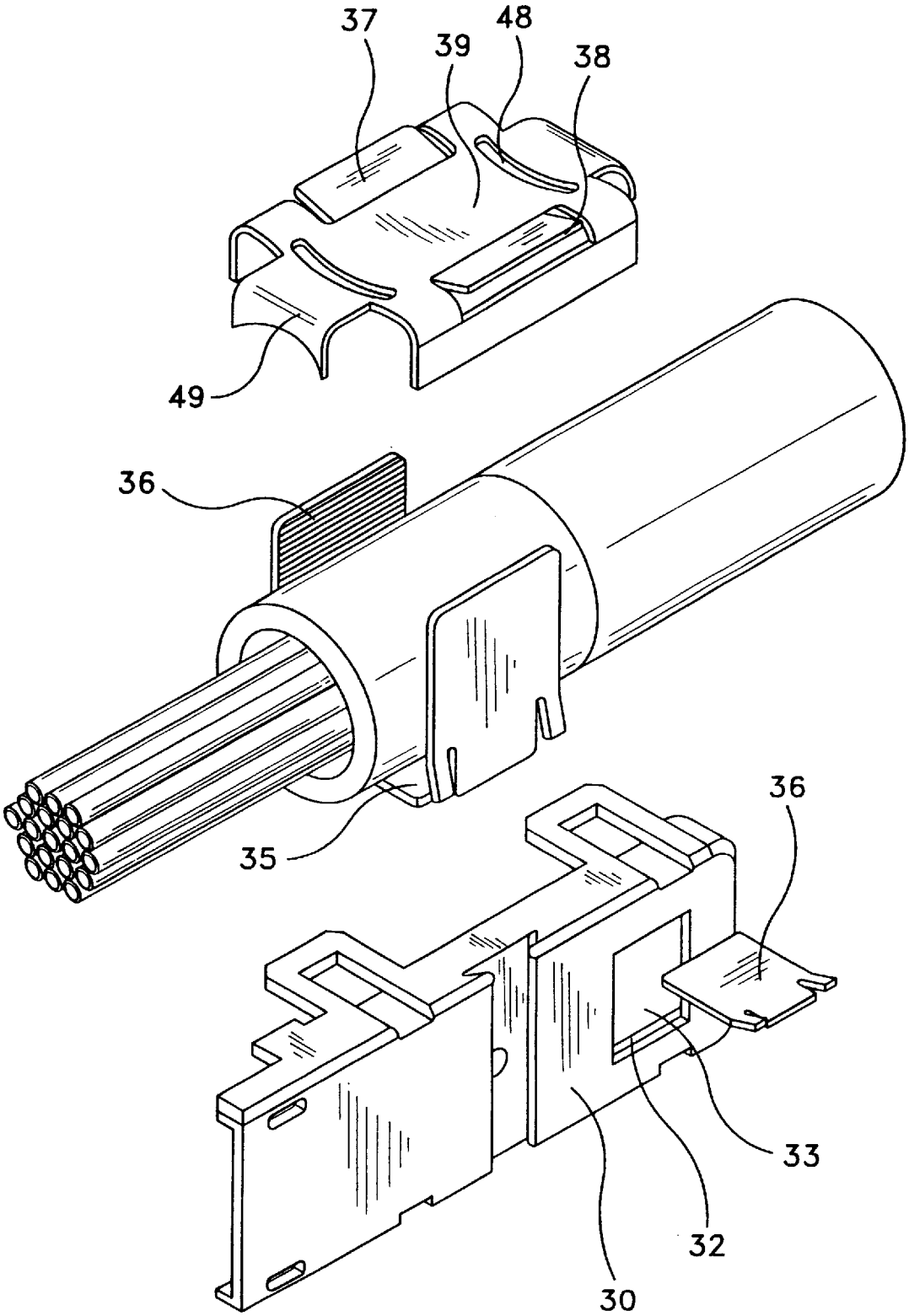

The lateral walls 9 of the chambers wall 5 are each provided with a projection 11 forming with the chamber base 6 an inwardly open groove 10, The counter contact 8 (FIG. 3) is provided on one or both sides with a cam 12 projecting over its lateral limit, which, when inserted into the chamber 6, slides in the groove 10 as far as a position beneath the projection 11. In this way account is taken of the fact that, due to the mirror-image half-and-half arrangement of the defining walls 4,5, there is formed for the spring contact a tilting edge, across which the spring contact 8 could tilt and possibly drop out of the chamber 6 before assembly of the contact carrier module. The groove-spring type guidance thus undertakes, for the period before assembly of the plug, the function of stabilizing the position of the spring contact 8 in the chamber 6. Furthermore, in order to center the spring contact 8 in the operative position, the legs 18 (of the springs) (FIG. 3) are provided with lateral guide cams 19 abutting against the lateral walls 9 of the chambers 6. The spring contacts shown in the drawing are blade-clamp contacts, whose blade clamping zone is formed by a pair of U-shaped upwardly or inwardly bent punched tabs or legs 21,22 forming a slot 20 with blade edges, and whose central legs 21 form with lateral legs 22 an obtuse angle of more than 90° . In this way, in contrast to known blade-clamping zones of this type with legs forming a right angle, a certain elasticity of shape of the blade legs is achieved, so that greater flexibility is obtained with respect to the use of cables of differing cable cress-sections, i.e. cables with a cross-section varying within wide limits may be simply applied to the same contacts. The spring contact 8 (FIGS. 3 and 4) is provided with clamp tabs 23 as insulation crimps. The module carrier casing 14 is further provided with mounts for attachment of a metal plate 26 as electrical shielding, which is provided on one side with windows (28) co-operating with corresponding cams 27 on the module carrier casing, and on the other side with resilient tabs 29 as an electrical connection to a ground conductor. The module carrier casing 14 is located in a two-part plug casing 30, 31, one portion 30 of which is provided with an external window-like recess 33 having lateral slots 32, and with an internal cavity for accommodating a clamp as a cable strain relief means. The clamp is formed (see in particularly FIGS. 2 and 9) by a U-shaped bow 35, 36 insertable from the outside through the slots 32, with lateral legs 36 having internal ribbing, and a clamp plate 39 insertable into the inner cavity, having slots 38 defined by exposed spring tongues 37, and into whose slots 38 the lateral legs 36 of the U-shaped bow engage with a snap action, wedging the exposed spring tongues 37 in their ribbing, this effect being reinforced by the ribbing; however this is also effective without ribbing as a result of a simple locking effect. In this way a cable strain relief means is obtained for conductors whose diameter varies within wide limits in that the ribbed legs 36 of the U-shaped bow are pushed to a greater or lesser degree into the slots 38 until the clamp engages securely on the cable. When shielded conductors are used, the metal shielding bent back after removal of insulation from the end of the conductor and the shield, is also engaged in the clamp 35, 36 and 39. The U-shaped bow 35, 36 and its clamp plate 39 is provided with inwardly projecting beads 48 pressing into the conductor insulation, and, complementing this, with claws 49 pressing into the insulation, only the respective claw facing away from the plug becoming effective.

Figure 2:
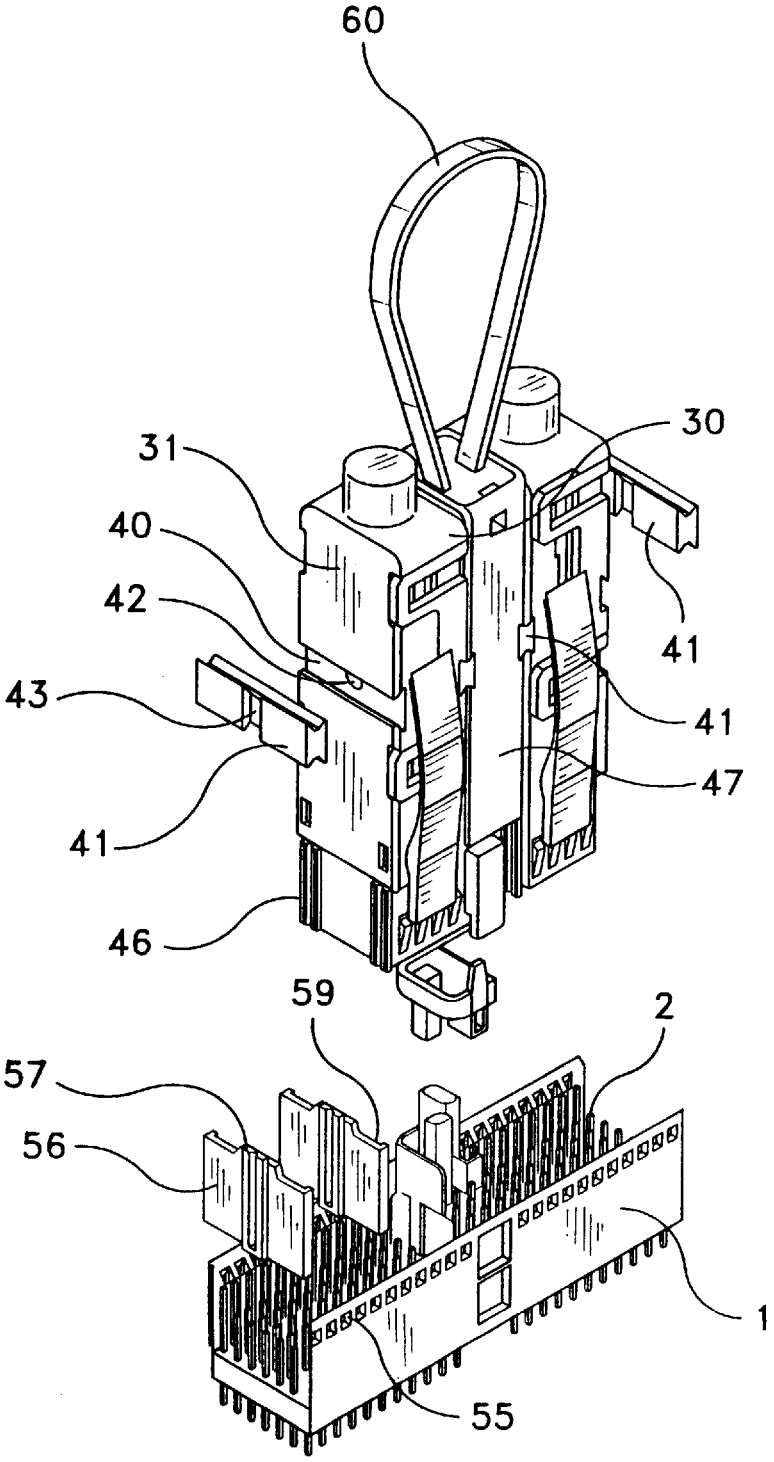
Figure 3:
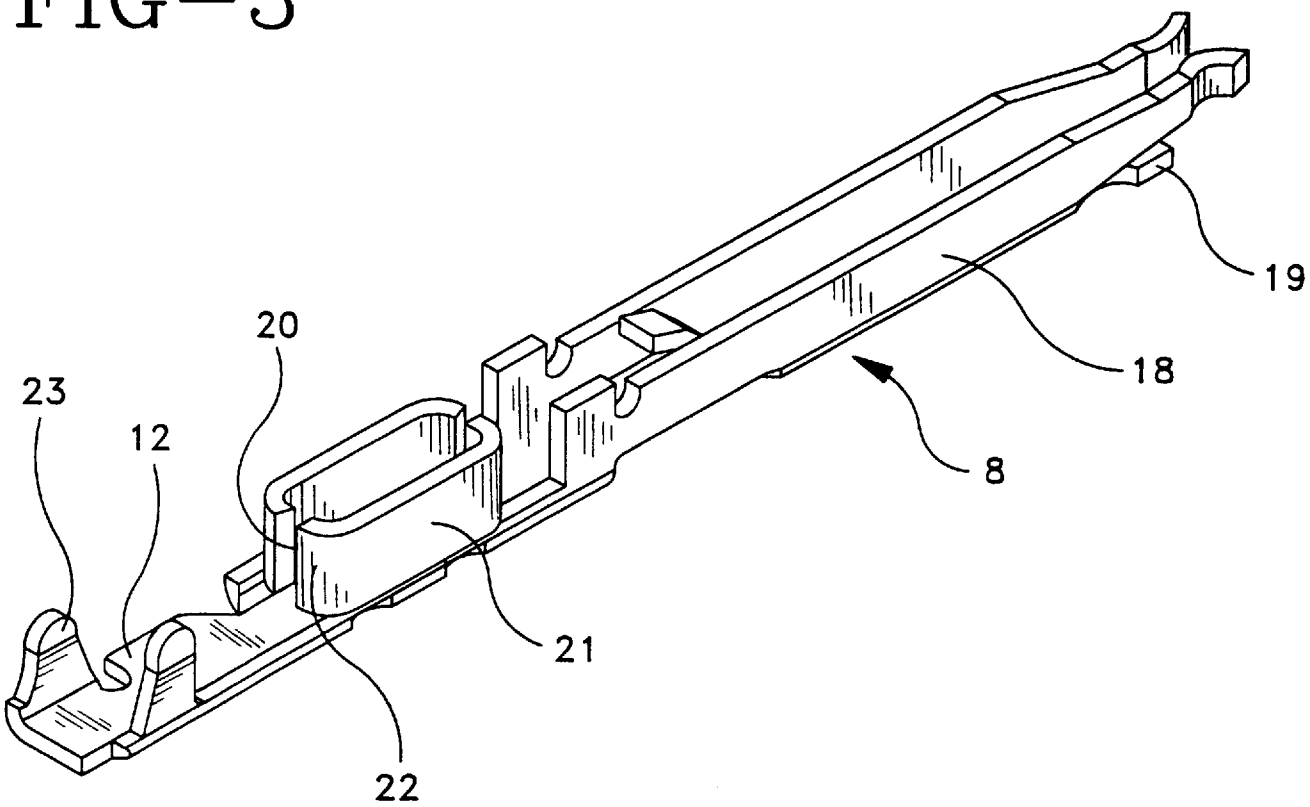

The two halves 30 and 31 of the plug casing are respectively provided with a dovetail-shaped groove 40 for insertion of a double-groove coupling member 41, with the aid of which an optional number of plugs may be combined to form a block as shown in FIG. 2 In this respect, in order to adjust the plugs in the block, the dovetail-shaped grooves 40 are provided with a cam 42, and the double-groove coupling member 41 is provided with a corresponding bead 43 co-operating with cam 42 to lock the coupling member 41 in the groove 40.

Figure 12:
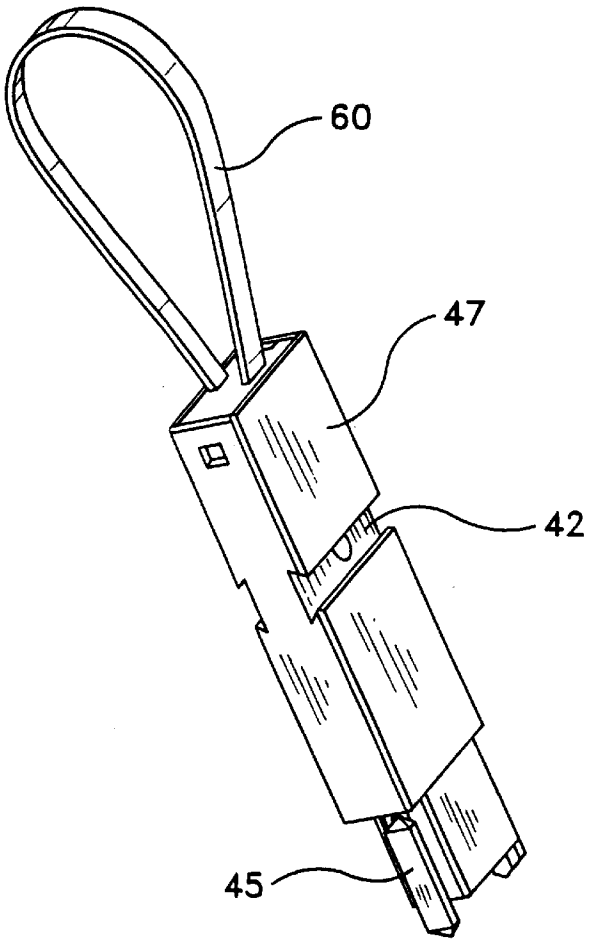

In this respect, in a particularly advantageous embodiment of the invention, referring to FIG. 12 there is provided an MF block 47, having coding, polarizing and guide cams independent of the plug casing, and which is combined with one or a plurality of plugs to form a block by means of a double-groove coupling member 4, earlier described. In this way a plug-in cable connector is provided in which coding and polarizing are effected independently of the plug so that, on the basis of identical components, the plug-in connector may be constructed in a way adaptable to all the special requirements of the user, and if necessary may be supplemented at a later point in time without requiring for this purpose the interchange of components which have meantime become superfluous or are no longer sufficient to meet the requirements. The module carrier casing 14 is provided on both sides with a C-shaped bow 50 on the module carrier housing. The bow so also projects through a corresponding window aperture of the plug casing 30, 31 and serves as a pivotal bearing for the axis of pivoting 51 of a snap locking means. The snap locking means which is formed by a double-armed lever 52 and 53 pivotal about the axis of pivoting 51, one lever arm 52 of which, serving as a power arm, is in the form of a resiliently curved clamp clip, and the other lever arm 53 of which, serving as a load arm, is provided with inwardly-oriented engagement projections 54 which, upon insertion of the plug into the blade strip 1 and 2 engage with a snap action in corresponding windows 55 of a series of windows provided for this purpose in the casing 1 of the blade strip. In this case also, depending on the conditions of use, it is possible optionally to insert one or a plurality of securing means on one side or on both sides of a plug or of a plug group; in the cases where a plug group with a coding block is used, the plug securing means may also be simply inserted on the coding block. In the locked position the lever arm 52 supported on the module carrier casing acts as a power arm which, because of its resilient effect, holds the load arm 53 in the locked position. The locking means is released by finger pressure or, in the case of a high packing density, by means of the action of an auxiliary tool on the curved lever arm 52, so that the double-armed lever is pivoted, disengaging the engagement projections 54 from windows 55 by pivoting about axis 51.

Figure 5:
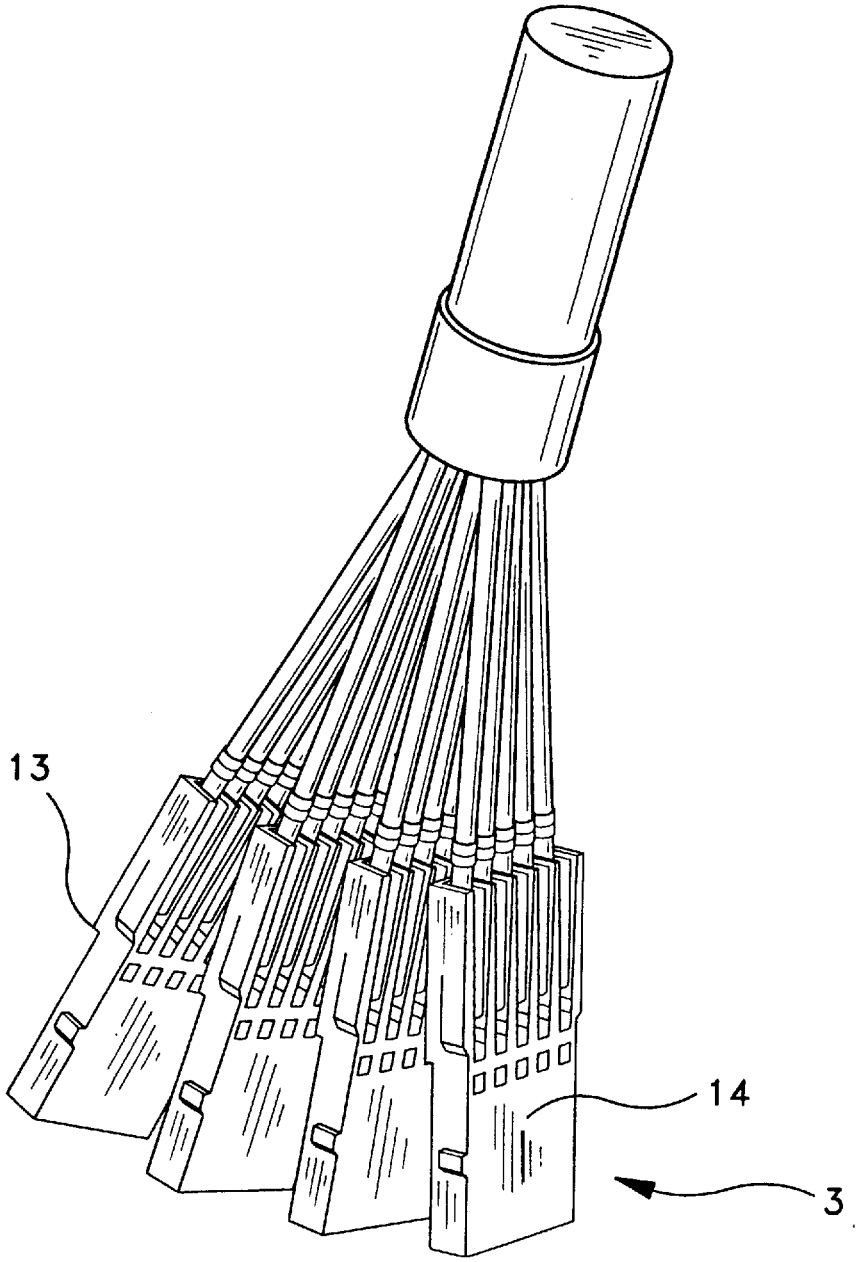
Figure 11:
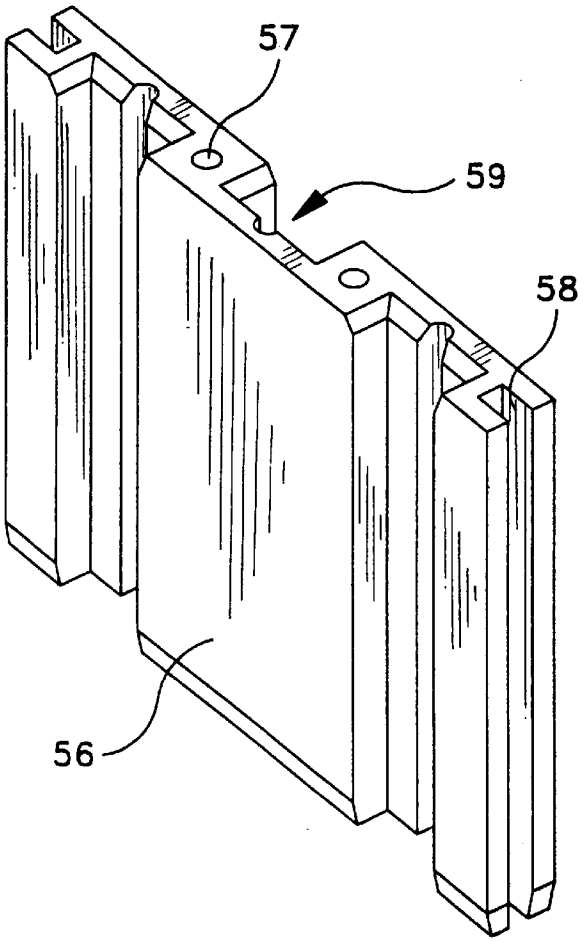

The advantageous embodiment shown in FIG. 5. illustrates a plug-in cable connector with four contact carrier modules 3 each having five respective contact receiving chambers, i.e. a 20-pole plug-in connector, which, taking into account standardization of the contact strips yields a 110 pole blade strip. In a blade strip corresponding to the standard, four 20-pole plug in cable connectors with MF block, or , in the case of 125-pole blade strips, up to five 20-pole plug-in connectors may be inserted without an MF block. In order to permit the use of only one or two plug-in cable connectors spaced apart from one another, plug-i type inserts are sub-divided on the blade strip 1 and 2 for which purpose (see FIGS. 2 and 11) walls 56 are provided which are provided with bores 57 and lateral grooves 58 corresponding to the blade contacts 2, and with vertical grooves 59 as counter guides for the polarizing webs 46 located on the module carrier casing 14. The walls may simultaneously serve as shielding and for this purpose are produced from a conductive material, or may be provided with a coating, for example an evaporated-on coating of a conductive material.

Having described the preferred embodiment of the invention herein, it should be appreciated that variations may be made thereto without departing from the contemplated scope of the invention. Accordingly, the Preferred Embodiments are intended to be illustrative rather than limiting, the true scope of the invention being set forth in the claims appended hereto.

We claim:

1. A plug-in cable connector for multi-lead cables comprising:

a strip casing (1,2) having a housing defining an inner cavity including a plurality of blade contacts (2) positioned therein;

at least one contact carrier module (3) for receiving a plurality of conductors from the multi-lead cable, the contact carrier module including a plurality of contact receiving chambers (6) and a contact having a conductor termination and a blade contact receiving end positioned within each chamber;

a module carrier casing (14) having an internal cavity for receiving the at least one contact carrier module (3); and an outer plug casing having a front wall rear wild side walls the plug casing receiving and housing the module carrier casing (14), wherein external surfaces of said sidewalls each include a dove-tail shaped groove (40) for receiving a double-groove cooperating coupling member for mechanically coupling a series of plug casings together to form a block he block being insertable into the strip casing so that the blade contact and the blade contact receiving ends of the at least one contact carrier module are electrically connectable.

2. A plug-in cable connector according to claim 1, wherein one of the module carrier casing (14) and a block (47) are provided with a C-shaped bow (50), projecting through a corresponding window recess in the plug casing (30, 31) on the module carrier casing, and also on the block (47) as a pivotal bearing for the axis of pivoting (51) of a snap locking means, which is formed by a doublearmed lever (52, 53) pivotal about the axis of pivoting (51) and one lever arm of which (52), serving as the power arm, is in the form of a resiliently-curved clamp, and the other lever arm (53) of which, serving as the load arm, is provided with inwardly-oriented engagement projections (54) which, upon insertion of the plug, engage with a snap action in windows (55) found in the strip casing (1,2).

3. A plug-in cable connector according to claim 2, wherein the strip casing is further provided with walls (56) for sub-dividing the strip casing into discrete sections.

4. A plug-in cable connector according to claim 2, wherein the block (47) is provided with a withdrawal loop (60).

5. A plug-in cable connector for multi-lead cables comprising:

a strip casing (1,2) having an inner cavity including a plurality of blade contacts (2) positioned therein;

at least one contact carrier module (3) having at least one contact receiving chamber (6) and a spring contact for receiving a conductor positioned within said chamber, the contact carrier module (3) having a rear wall (5), a front wall (4) substantially parallel to said rear wall and a pair of sidewalls (9) connecting said front and rear walls, wherein the rear wall (5) extends from approximately a mid-section of the contact carrier module to approximately a top portion thereof and said front wall extends from approximately the mid-section of the contact carrier module to approximately a bottom portion thereof, at least one of said sidewalls including a stop means (13); and a module carrier casing (14) having at least one internal cavity for receiving the contact carrier module, the module carrier casing (14) having at least one half-height wall forming a receiving chamber (15) for the at least one contact carrier module (3) whereby upon insertion of the contact carrier module (3) into the module carrier casing, the stop means of the contact carrier module engage the half-height wall of the module carrier casing and the half-height wall and the rear wall complement one another to form a substantially continuous wall extending over an entire length of the contact carrier module substantially enclosing each contact receiving chamber (6), wherein each of the side walls (9) is provided with a projection (11) thereon, and the spring contact is provided with a lug (12) projecting beyond a side of the lateral wall of the spring contact so that upon insertion of the spring contact (8) into the chamber (6), the lug slides in the chamber until the lug reaches a locked position beneath the projection (11).

6. A plug-in cable connector according to claim 5, wherein the contact includes spring legs (18) which are provided with lateral guide cams the guide cams being guided on the side walls (9) of the chamber (6) upon insertion to center the spring contacts in the chamber.

7. A plug-in cable connector according to claim 5 wherein an insulation displacement zone of the spring contacts (8) is formed by a pair of punched tabs (21, 22) which are bent in a U-shape and forming a slot (20) with blade edges, the central legs (21) of the punched tabs forming with the lateral legs (22) an angle of more than 90°.

8. A plug-in cable connector according to claim 7, wherein the contact is provided with clamp tabs (23) as insulation crimps.

9. A plug-in cable connector according to claim 5, wherein the module carrier casing (14) is provided with mounts for attachment of a metal plate (26) for electrical shielding.

10. A plug-in cable connector for multi-lead cables comprising:

a strip casing (1,2) having an inner cavity including a plurality of blade contacts (2) positioned therein;

at least one contact carrier module (3) having at least one contact receiving chamber (6) and a spring contact for receiving a conductor positioned within said chamber, the contact carrier module (3) having a rear wall (5), a front wall (4) substantially parallel to said rear wall, and a pair of sidewalls (9) connecting said front and rear walls, wherein the rear wall (5) extends from approximately a mid-section of the contact carrier module to approximately a top portion thereof and said front wall extends from approximately the mid-section of the contact carrier module to approximately a bottom portion thereof at least one of said sidewalls including a stop means (13); and a module carrier casing (14) having at least one internal cavity for receiving the contact carrier module, the module carrier casing (14) having at least one half-height wall forming a receiving chamber (15) for the at least one contact carrier module (3) whereby upon insertion of the contact carrier module (3) into the module carrier casing, the stop means of the contact carrier module engage the half-height wall of the module carrier casing and the half-height wall and the rear wall complement one another to form a substantially continuous wall extending over an entire length of the contact carrier module substantially enclosing each contact receiving chamber (6), wherein the module carrier casing (14) is located in a two-part plug casing (30, 31), one portion (30) of which is provided with an external window-like recess (33) having lateral slots (32) with an internal cavity for attachment of a clamp as a plug strain relief means, the strain relief means being formed by a U-shaped bow (35, 36) insertable from outside through the slots (32), the bow including lateral legs (36) ribbed on an inner side thereof and by a clamp plate (39) insertable into the internal cavity, the clamp plate having slots (38) defined by exposed spring tongues (37), the lateral legs (36) of the U-shaped bow being insertable into the slots (38) thereby engaging the exposed spring tongues (37) in the ribbing of the legs (36).

11. A plug-in cable connector according to claim 10, wherein the U-shaped bow (35, 36) and the clamp plate (39) of the cable strain relief means are provided with one of beads (48) and claws (49) for pressing into the cable insulation.

12. A plug-in cable connector according to claim 11, wherein the portions (30, 31) of the plug casing are provided with cooperating coupling members (41) so that a plurality of plugs may be combined into a block.

* * * * *

UNITED STATES PATENT AND TRADEMARK OFFICE

CERTIFICATE OF CORRECTION

PATENT NO. : 5,772,475
DATED : June 30, 1998
INVENTOR(S) : Lindeberg et al.

It is certified that error appears in the above-indentified patent and that said Letters Patent is hereby corrected as shown below:

In Column 1, Line 47, now reads "contact,:"
this should read --contact;--

In Column 2, Line 12, now reads "closed, and on thee"
this should read --closed, and on the--

In Column 2, Line 13, now reads "closed, The"
this should read --closed. The--

In Column 2, Line 14, now reads "a shoulder 13."
this should read --form a shoulder 13.--

In Column 2, Line 18, now reads "modules 3 The wall 5"
this should read --modules 3. The wall 5--

In Column 2, Lines 18-21, now reads "9 half open side portion of the complement one another to form A intermediate wall entirely covering or enclosing the contact"
this should read: --9 complement one another to form an intermediate wall entirely covering or enclosing the half open side portion of the contact--

UNITED STATES PATENT AND TRADEMARK OFFICE

CERTIFICATE OF CORRECTION

PATENT NO. : 5,772,475

DATED : June 30, 1998

INVENTOR(S) : Lindeberg et al.

It is certified that error appears in the above-indentified patent and that said Letters Patent is hereby corrected as shown below:

In Column 2, Line 32, now reads "10, The counter"
this should read --10. The counter--

In Column 3, Line 19, now reads "shielding bent"
this should read --shielding is bent--

In Column 3, Line 41, now reads "member 4, earlier"
this should read -- member 41 earlier--

In Column 3, Line 52, now reads "The bow so also projects"
this should read -- The bow 50 also projects--

In Column 4, Lines 54-55, now reads "having a front wall rear wild side walls the plug"
this should read -- having a front wall, rear wall and side walls, the plug--

In Column 4, Line 60, now reads "to form a block he block"
this should read -- to form a block, the block--

Signed and Sealed this

Twenty-second Day of September, 1998

*Attest:*

Bruce Lehman

BRUCE LEHMAN

*Attesting Officer*

*Commissioner of Patents and Trademarks*